US008057185B2

(12) United States Patent
Brendel

(10) Patent No.: US 8,057,185 B2
(45) Date of Patent: Nov. 15, 2011

(54) FORWARD SWEPT CENTRIFUGAL FAN WHEEL

(75) Inventor: Michael Brendel, Centerville, OH (US)

(73) Assignee: Lau Industries, Dayton, OH (US)

( * ) Notice: Subject to any disclaimer, the term of this patent is extended or adjusted under 35 U.S.C. 154(b) by 829 days.

(21) Appl. No.: 12/069,497

(22) Filed: Feb. 11, 2008

(65) Prior Publication Data

US 2009/0202352 A1 Aug. 13, 2009

(51) Int. Cl.
*F04D 5/00* (2006.01)
*F04D 29/28* (2006.01)

(52) U.S. Cl. ..... 416/178; 415/53.1

(58) Field of Classification Search ..... 415/53.1, 415/203, 224; 416/178, 182, 185, 186 R, 416/187
See application file for complete search history.

(56) References Cited

U.S. PATENT DOCUMENTS

| | | | | |
|---|---|---|---|---|
| 1,333,294 | A * | 3/1920 | Denton | 416/187 |
| 1,676,946 | A | 10/1928 | Fechheimer | |
| 1,965,171 | A | 3/1934 | Boyer | |
| 2,878,989 | A | 3/1959 | Sprouse | 230/134 |
| 2,980,990 | A | 4/1961 | Sprouse | 29/156.8 |
| 3,221,398 | A | 12/1965 | Mayne | |
| 4,236,871 | A | 12/1980 | Hirst et al. | 416/186 R |
| 4,436,484 | A | 3/1984 | Temple et al. | 416/178 |
| 5,478,201 | A | 12/1995 | Amr | 415/206 |
| 5,611,667 | A * | 3/1997 | Nagamori et al. | 416/178 |
| 5,827,046 | A * | 10/1998 | Konno et al. | 416/178 |
| 6,007,300 | A | 12/1999 | Sacki et al. | 416/178 |
| 6,508,630 | B2 * | 1/2003 | Liu et al. | 416/228 |
| 7,008,189 | B2 | 3/2006 | Jarrah et al. | 416/175 |
| 7,108,482 | B2 | 9/2006 | Chapman | 416/185 |
| 2008/0075599 | A1 * | 3/2008 | Miller | 416/182 |

FOREIGN PATENT DOCUMENTS

| | | |
|---|---|---|
| DE | 39 26 456 | 2/1991 |
| GB | 479823 | 11/1938 |

* cited by examiner

*Primary Examiner* — Edward Look
*Assistant Examiner* — Liam McDowell
(74) *Attorney, Agent, or Firm* — Jeffrey A. Thurnau, Esq.; Thomas A. Dougherty, Esq.; Paul N. Dunlap, Esq.

(57) ABSTRACT

A forward swept centrifugal fan wheel comprising a first endring (10), a second endring (11), a plurality of blades (12) connected between the first endring and the second endring, each blade having a substantially continuous arcuate form extending along an axis parallel to an axis of rotation (A-A), and each blade having a substantially continuous arcuate cross-section taken with respect to a plane which extends normally from the axis of rotation (A-A).

5 Claims, 8 Drawing Sheets

FORWARD SWEPT CENTRIFUGAL FAN WHEEL

FIELD OF THE INVENTION

The invention relates to a forward swept centrifugal fan wheel, and more particularly, to a forward swept centrifugal fan wheel having blades having a substantially continuous arcuate form extending along an axis parallel to an axis of rotation, and each blade having a substantially continuous arcuate cross-section taken with respect to a plane which extends normally from the axis of rotation.

BACKGROUND OF THE INVENTION

Centrifugal fan wheels are used in a wide variety of applications. Many of these applications utilize a centrifugal wheel with a forward curved blade design, often referred to as a forward curved fan. A forward curved fan wheel has the advantage of being relatively compact in size for the amount of air that it can move. In contrast, a centrifugal fan wheel with rearward curved blades is typically larger, or must turn at a greater speed, than a comparable forward curved fan. It is for this reason that forward curved fans are used in many residential, commercial, industrial, and automotive applications.

However, a typical forward curved fan will only provide stable and efficient airflow over a relatively narrow operating range. Conditions which present too high of an airflow restriction may result in unsteady airflow delivery and excessive noise. Likewise, too little airflow restriction can have a similar effect on performance. Because of these limitations forward curved fans must be selected to avoid these undesirable affects, which in many instances will unnecessarily limit design options and lead to less desirable performance or higher costs.

A forward curved fan wheel commonly employs a centerdisk (or centerdisks), a series of blades, and two endrings. The centerdisk is driven by a shaft attached to a motor or some other suitable drive. The center of each blade is attached to the centerdisk with the blade ends secured to the endrings. Further, the blades are straight in that a straightedge will be parallel to the lateral edges of the blades. This geometry is largely responsible for the aerodynamic and acoustic performance limitations described above. The wheels are usually made of steel, although other metals and plastics are used.

Representative of the art is U.S. Pat. No. 3,854,844 which discloses an improved blower wheel is disclosed in which the end rings are formed from flat stock material which has been partially preformed by rolling and cut to the desired length. The center disks are stamped from sheet material which may be of a different gauge than that of the end rings and formed with peripheral notches and a U-shaped crimp to engage the inner section of each of the blades. The arrangement permits selection of center disk material without regard to end ring material, provides versatility in selecting blower wheel size and eliminates production inventory balance problems which occur when the center disk and end rings are stamped from the same material.

What is needed is a forward swept centrifugal fan wheel having blades having a substantially continuous arcuate form extending along an axis parallel to an axis of rotation, and each blade having a substantially continuous arcuate cross-section taken with respect to a plane which extends normally from the axis of rotation. The present invention meets this need.

SUMMARY OF THE INVENTION

The primary aspect of the invention is to provide a forward swept centrifugal fan wheel having blades having a substantially continuous arcuate form extending along an axis parallel to an axis of rotation, and each blade having a substantially continuous arcuate cross-section taken with respect to a plane which extends normally from the axis of rotation.

Other aspects of the invention will be pointed out or made obvious by the following description of the invention and the accompanying drawings.

The invention comprises a forward swept centrifugal fan wheel comprising a first endring, a second endring, a plurality of blades connected between the first endring and the second endring, each blade having a substantially continuous arcuate form extending along an axis parallel to an axis of rotation, and each blade having a substantially continuous arcuate cross-section taken with respect to a plane which extends normally from the axis of rotation.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

Figure 1:
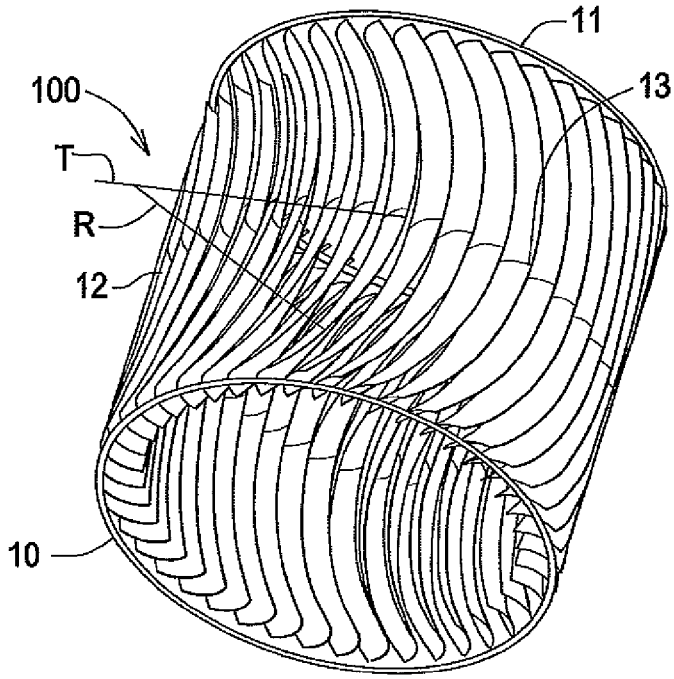
FIG. 1 is a perspective view of the fan wheel.

FIG. 1 is a perspective view of the fan wheel. The inventive fan wheel is used in air handling applications.

The fan wheel 100 comprises an endring 10 and an endring 11. Connected between endrings 10, 11 is a plurality of blades 12. A centerdisk 14 and axle 150 are omitted for clarity, see FIG. 3.

Each blade 12 comprises a combination of various arcuate forms. No portion of blade 12 is flat or linear. When viewed in plan each blade describes a continuous arc extending from one endring 10 to the other endring 11 in a direction that is parallel to an axis of rotation A-A. In other embodiments, the arc may be circular having constant radius R with respect to a point on a tangent line T, which line T extends on a tangent from the perimeter of the fan wheel at the location of each blade, and from a center 13 of each blade. The arcuate form of each blade may also be parabolic or other suitable combination of arcuate sections, including circular and parabolic.

By employing this type of blade geometry, the fan is found to have favorable performance attributes when compared to a conventional straight-blade forward curved centrifugal fan.

Figure 2:
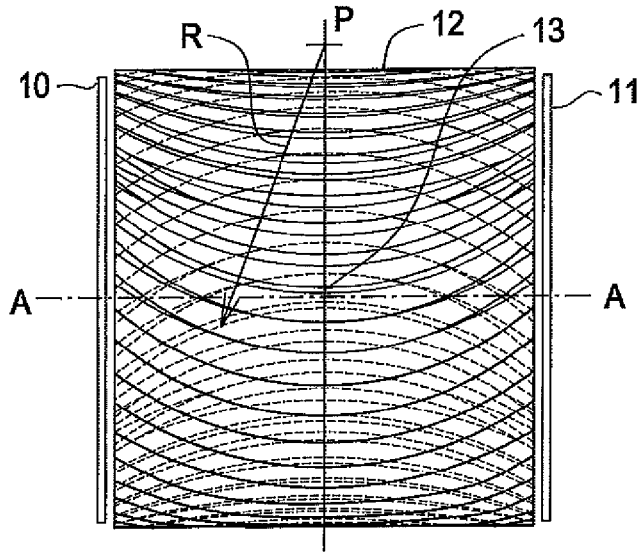
FIG. 2 is a front view of the fan wheel.

FIG. 2 is a front view of the fan wheel. Radius R for each blade 12 extends from point P. Point P is midway between rings 10, 11 and is aligned with 13. The center leading point 13 of each blade 12 projects in the direction of rotation "D" of the fan wheel. The axis of rotation of the fan wheel is axis A-A. The sweep is defined as the distance along tangent line T from the leading point 13 to the connection between each blade and ring 10 or 11.

Figure 3:
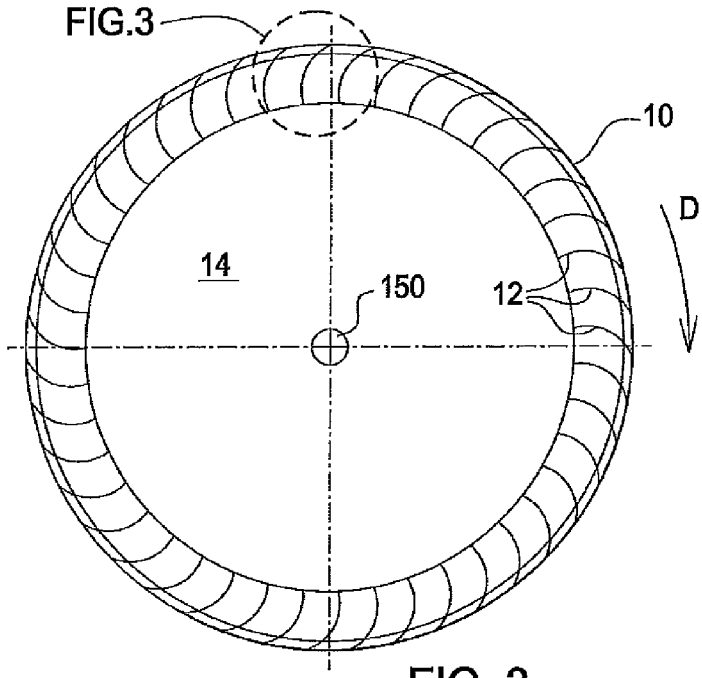
FIG. 3 is a side view of the fan wheel.

FIG. 3 is a side view of the fan wheel. Centerdisk 14 is connected to and supports each blade 12. Axle 150 is connected to centerdisk 14. Axle 150 is borne in bearings and is also connected to a driver known in the art such as an electric motor (not shown). The fan wheel rotates in direction D.

Figure 4:
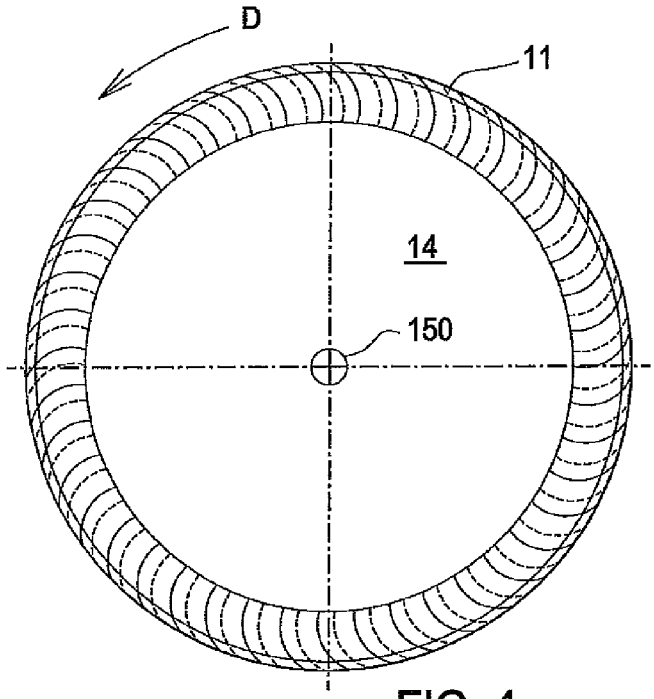
FIG. 4 is a side view of the fan wheel.

FIG. 4 is a side view of the fan wheel.

Figure 5:
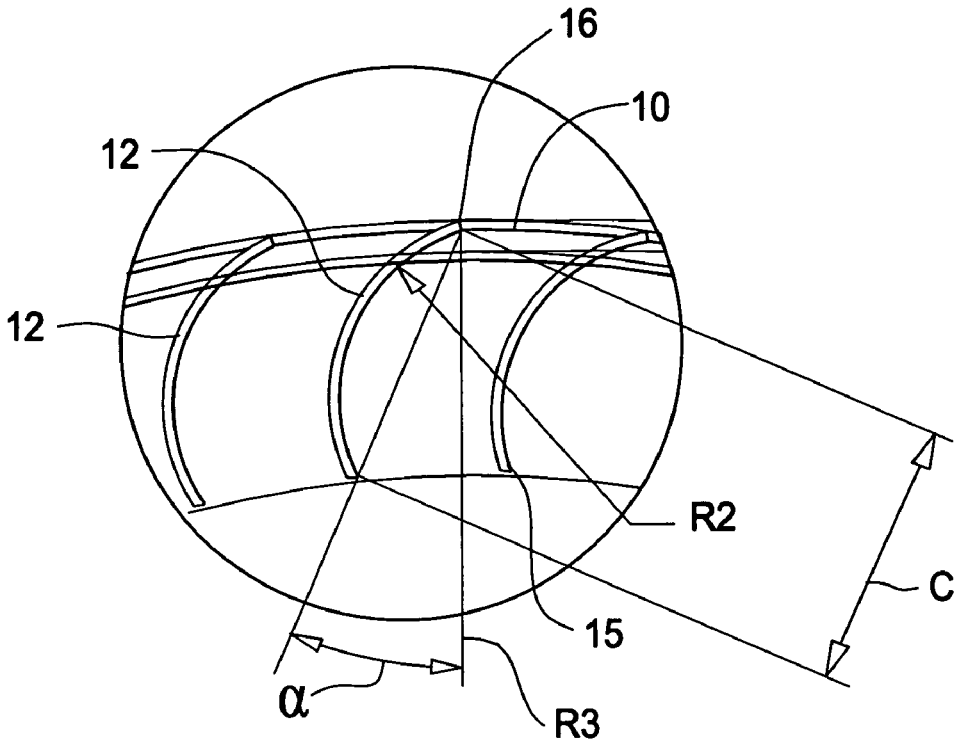
FIG. 5 is a detail from FIG. 3.

FIG. 5 is a detail from FIG. 3. With respect to air flow direction, each blade 12 comprises a leading edge 15 and a trailing edge 16. A chord C extends from the leading edge to the trailing edge. In this side view each blade has a constant radius R2, which radius contacts the leading edge and trailing edge. As such, each blade has a continuous arcuate cross-section with respect to a reference plane which extends normally from a fan wheel axis of rotation A-A. The reference plane is the viewing plane for FIG. 5. Referring to chord C, the trailing edge 16 is disposed with respect to the leading edge 15 by an angle $\alpha$, which angle is with respect to a line R3 drawn through the axis of rotation A-A of the fan wheel. Angle $\alpha$ is in the range of 20° to 30° with the preferred angle being approximately 24°.

Figure 6:
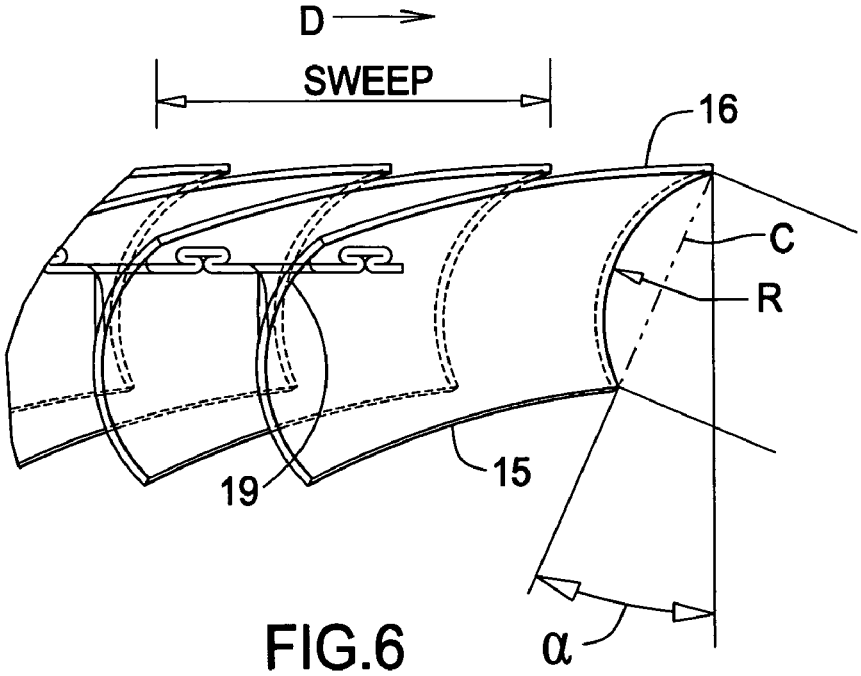
FIG. 6 is a detail of the fan blades.

FIG. 6 is a detail of the fan blades. The fan wheel may be manufactured using formed metal or may comprise molded plastic. FIG. 6 illustrates a means of connecting each blade to each ring of a metal wheel. A tip 19 of each blade 12 is captured during the manufacturing process within ring 10.

Figure 7:
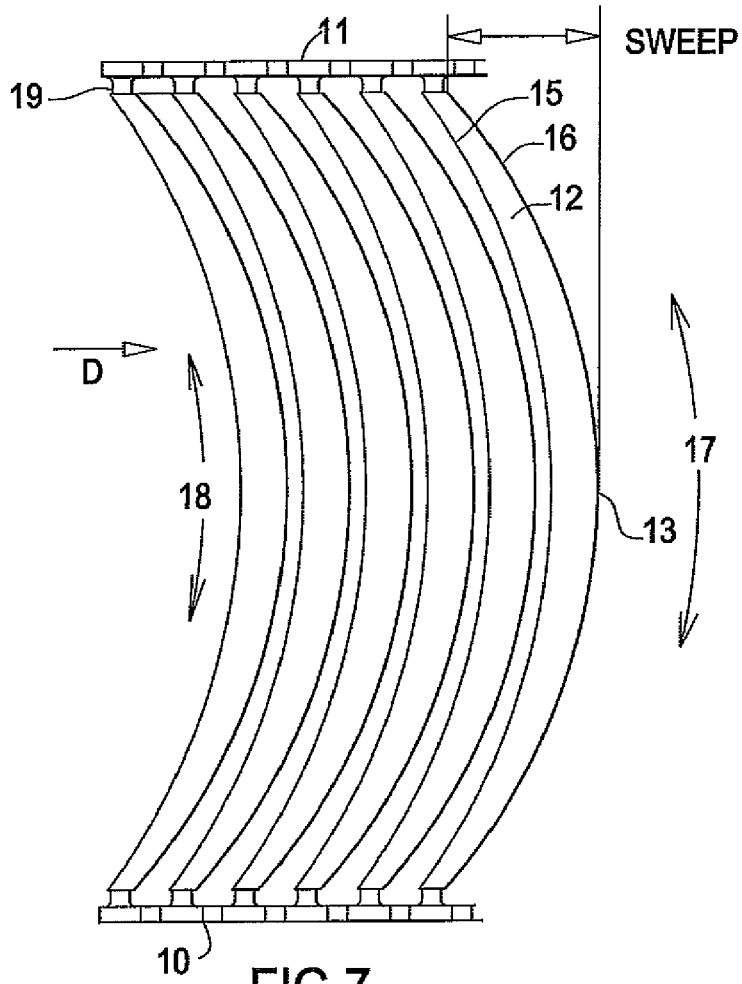
FIG. 7 is a detail of the fan blades.

FIG. 7 is a plan detail of the fan blades. The curved nature of each blade causes each blade to have a convex portion 17 and a concave portion 18. The convex portion 17 of each blade 12 projects toward the direction of rotation D of the fan wheel.

Figure 8:
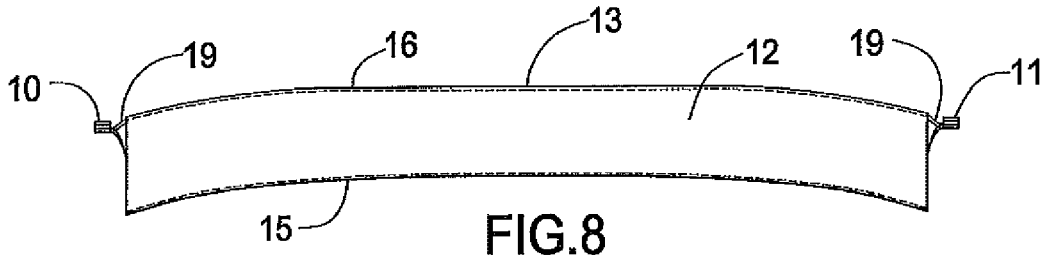
FIG. 8 is a fan blade front view.

FIG. 8 is a fan blade front view.

Figure 9:
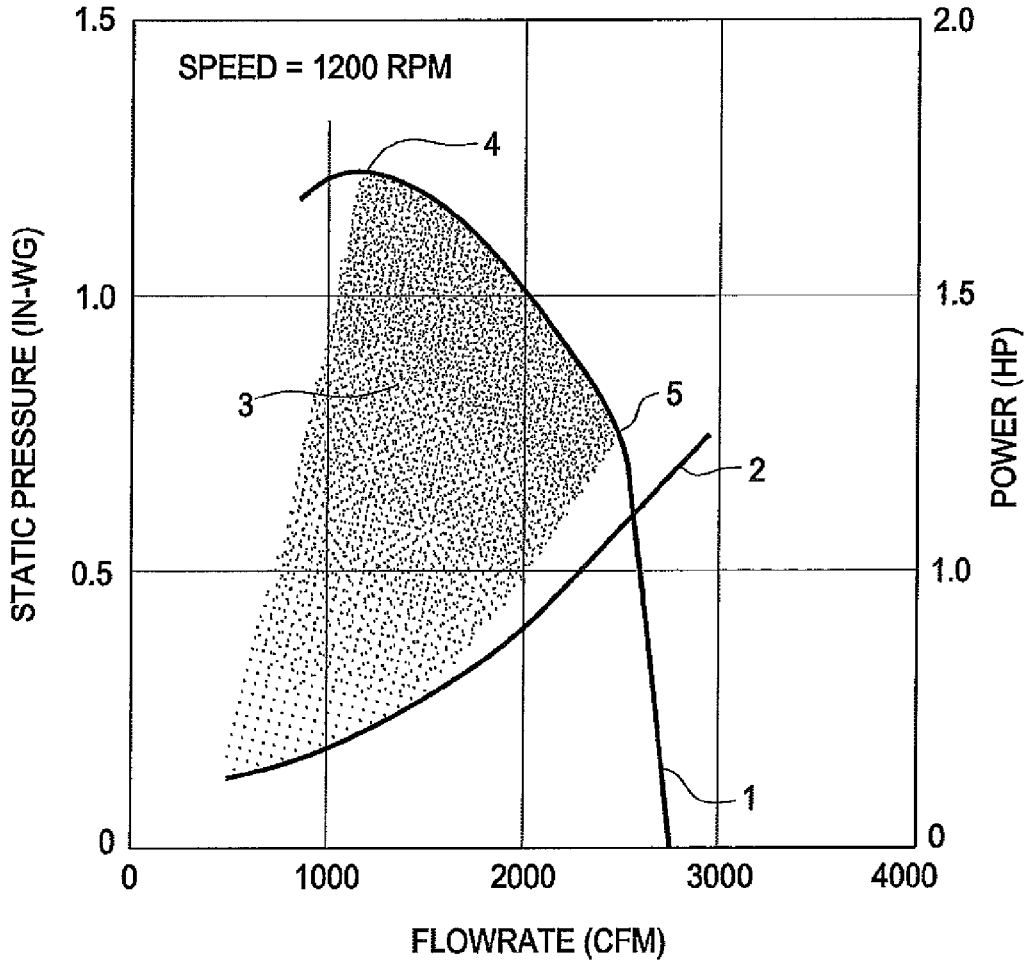
(PRIOR ART) FIG.9
FIG. 9 is a fan curve showing the prior art.

FIG. 9 is a fan curve showing the prior art. Curve number 1 is a typical prior art flow-pressure fan characteristic. Curve number 2 is a typical prior art flow-power fan characteristic. Area number 3 is a typical prior art operating regime.

Point number 4 is a typical prior art operating regime upper bound. Operation to the left of point 4 may produce unsteady airflow and additional noise.

Point 5 is a typical prior art operating regime lower bound. Operation to the right of point 5 may produce unsteady airflow and additional noise.

The fan speed for FIGS. 9, 10, 11 and 12 is 1200 RPM.

Figure 10:
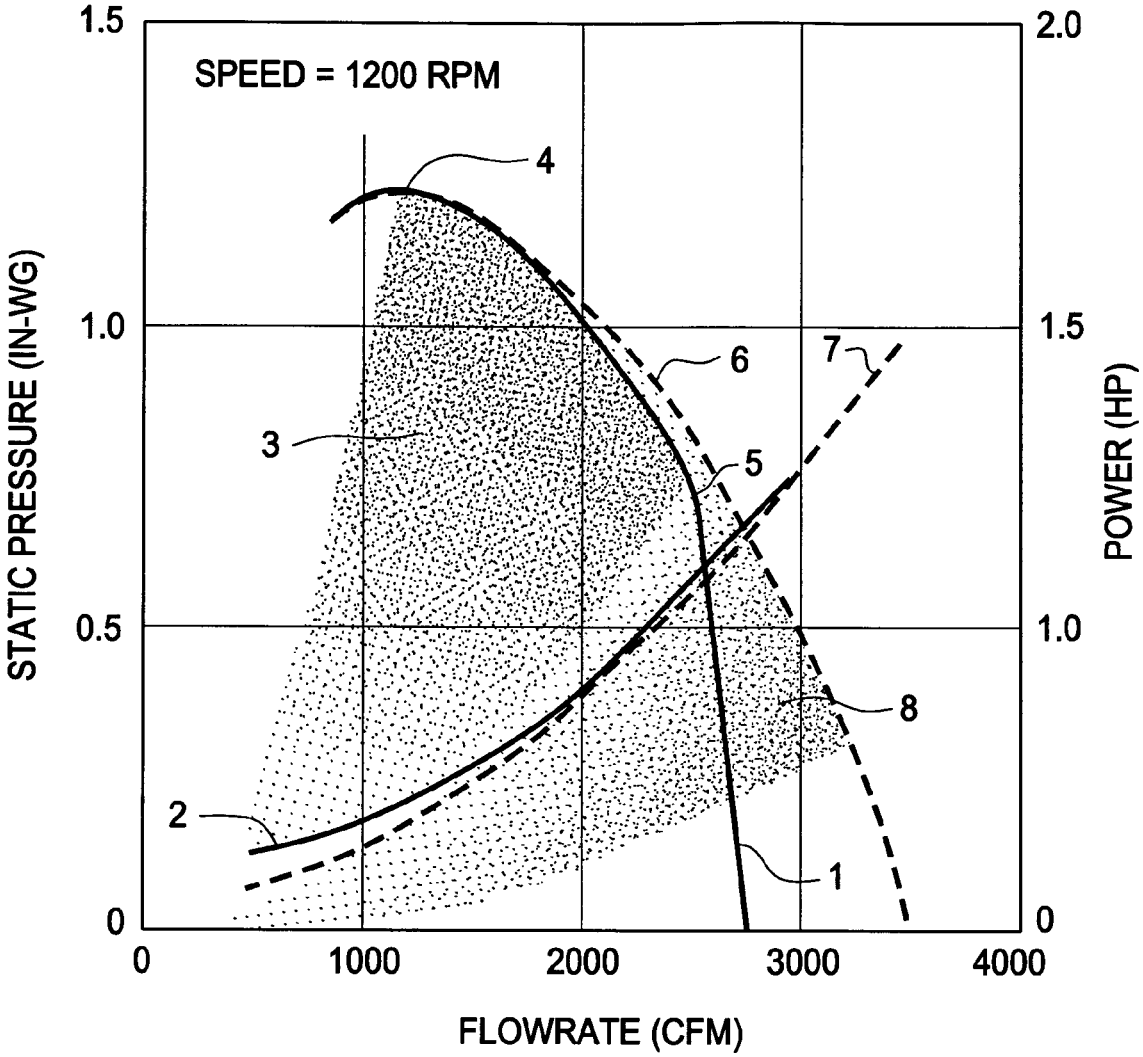
FIG. 10 is a fan curve showing the improved fan wheel compared with the prior art.

FIG. 10 is a fan curve showing the improved fan wheel compared with the prior art. Curve number 6 is a flow-pressure fan characteristic for the inventive fan wheel. Curve number 7 is a flow-power fan characteristic for the inventive fan wheel. Area number 8 is additional operating regime for the inventive fan wheel. Airflow in this regime area 8 is stable and noise is reduced compared to the prior art regime (3). One can see that the enhanced operating regime (3+8) is approximately doubled over the prior art (3), while adding up to approximately 500 CFM of flow for a given static pressure.

Figure 11:
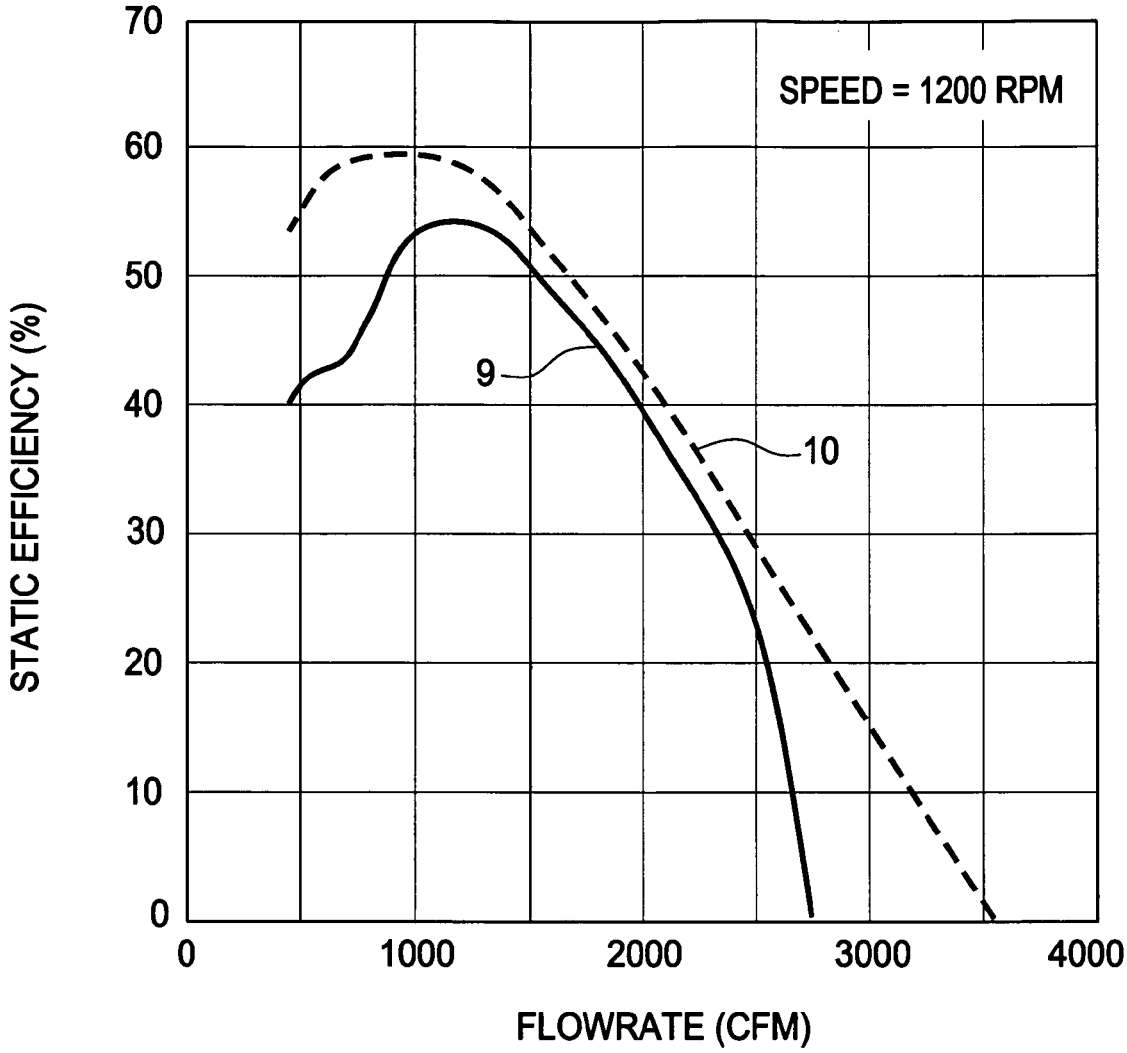
FIG. 11 is a graph showing static efficiency comparison.

FIG. 11 is a graph showing static efficiency comparison. Curve number 9 is typical prior art static efficiency. Curve number 10 is static efficiency for the inventive fan wheel. The new fan wheel curve is more efficient at higher flow rates (>2500 CFM) and demonstrates an efficiency improvement of up to approximately 10% at low flow rates.

Figure 12:
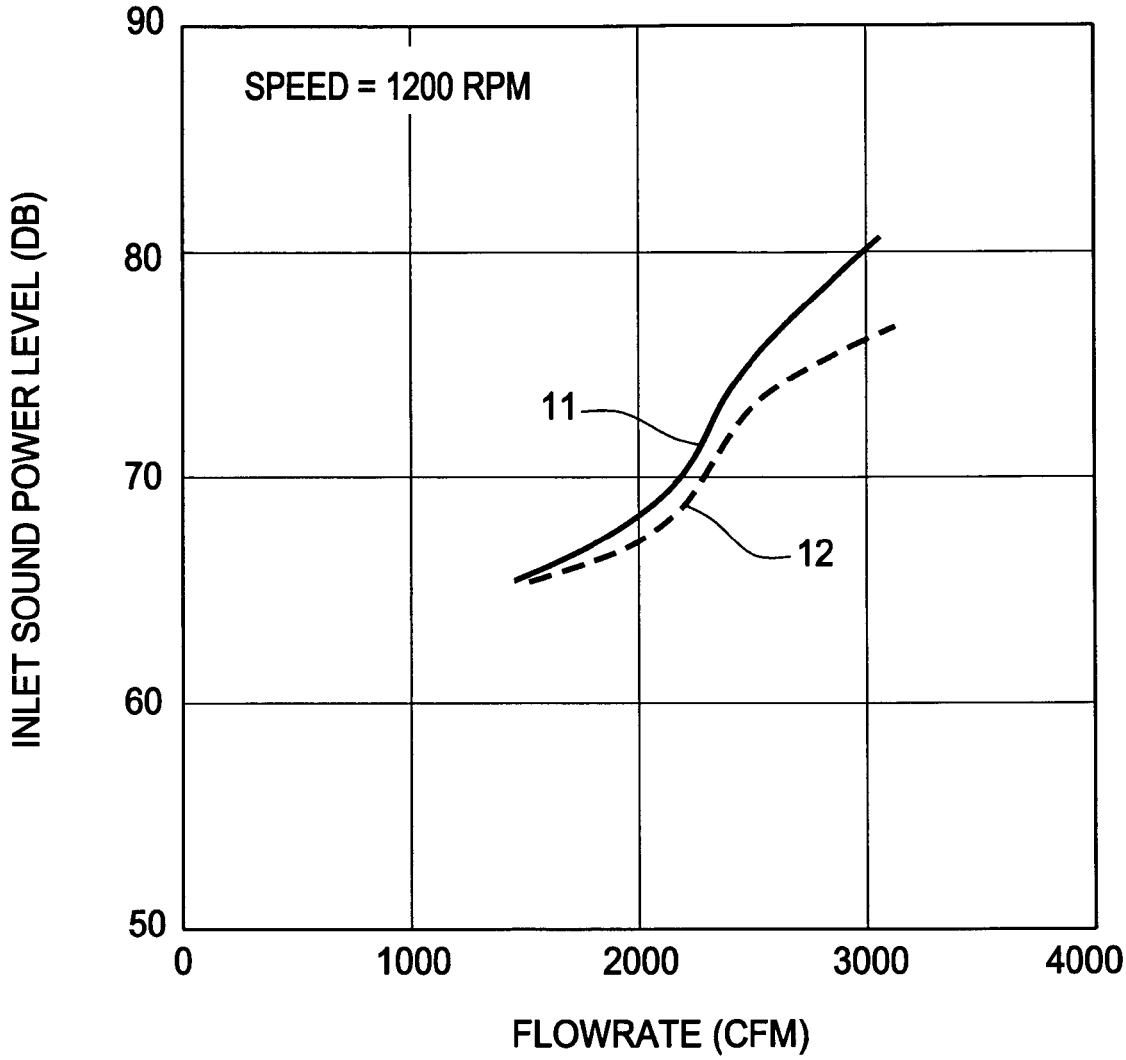
FIG. 12 is a graph showing inlet sound power comparison.

FIG. 12 is a graph showing inlet sound power comparison. Curve number 11 is typical prior art inlet sound power. Curve number 12 is inlet sound power level for the inventive fan wheel.

The inventive fan wheel is significantly quieter at flow rates of approximately 3000 CFM, approaching ~4 dB. Hence, the inventive fan wheel achieves a readily perceived decrease in sound of approximately 4 dB for a given fan speed of 1200 RPM at 3000 CFM. This represents a decrease in sound intensity of approximately 2.5 times.

Although a form of the invention has been described herein, it will be obvious to those skilled in the art that variations may be made in the construction and relation of parts and method without departing from the spirit and scope of the invention described herein.

I claim:

1. A forward swept centrifugal fan wheel comprising:

a first endring (10);

a second endring (11);

a plurality of blades (12) connected between the first endring and the second endring, each blade having a substantially continuous arcuate form that extends from the first endring to the second endring along an axis parallel to an axis of rotation (A-A); and each blade having a substantially continuous arcuate cross-section taken with respect to a plane which extends normally from the axis of rotation (A-A); and each blade when viewed in plan with a tangent line (T) is disposed in the plan, having a point (P) midway between the first endring and the second endring such that the point (P) leads each blade in the direction of rotation (D) of the wheel in a convex blade orientation.

2. The forward swept centrifugal fan wheel as in claim 1, wherein the arcuate form comprises a circular section comprising a radius (R) and taken with respect to a tangent line (T).

3. The forward swept centrifugal fan wheel as in claim 1, wherein a convex portion (17) of the blade projects in the direction of rotation (D) of the fan wheel.

4. The forward swept centrifugal fan wheel as in claim 1, wherein each blade comprises a leading edge (15) and a trailing edge (16), the trailing edge disposed behind the leading edge with respect to a direction of rotation.

5. The forward swept centrifugal fan wheel as in claim 1, wherein the arcuate form comprises a parabolic section.

* * * * *